United States Patent [19]

Painter

[11] 4,392,596

[45] Jul. 12, 1983

[54] HOSIERY TRIMMING APPARATUS

[76] Inventor: James D. Painter, 2140 Lois St., SE., Cleveland, Tenn. 37311

[21] Appl. No.: 237,594

[22] Filed: Feb. 24, 1981

[51] Int. Cl.[3] ..... A41H 43/02

[52] U.S. Cl. ..... 223/43; 223/77

[58] Field of Search ..... 223/39, 43, 77

[56] References Cited

U.S. PATENT DOCUMENTS

| | | | |
|---|---|---|---|
| 2,454,622 | 11/1948 | Ammon | 223/77 |
| 2,899,116 | 8/1959 | Long et al. | 223/43 |
| 3,126,134 | 3/1964 | McAnally | 223/43 |
| 3,532,258 | 10/1970 | Kienel | 223/77 X |
| 3,977,580 | 8/1976 | Vecchia | 223/43 |
| 4,281,781 | 8/1981 | Pope | 223/43 X |

*Primary Examiner*—Louis Rimrodt

*Attorney, Agent, or Firm*—Gipple & Hale

[57] ABSTRACT

There is disclosed an apparatus and process for finishing hosiery articles such as men's, women's and children's socks. Each sock is placed inside-out on an elongated hollow tubular member, with the toe seam covering a first open end of the tubular member. The tubular member is rotated adjacent shears so that unfinished threads extending from each sock are trimmed and removed. A stretching ram is then inserted in the first open end of the tubular member to sandwich each sock between the ram and the tubular member, and a portion of the ram then extends through the tubular member to stretch the sock and thereby straighten the toe seam. The stretching ram is removed, and pressurized air forces the sock through the hollow tubular member and out a second open end of the tubular member in a rightside-out condition.

6 Claims, 9 Drawing Figures

HOSIERY TRIMMING APPARATUS

BACKGROUND OF THE INVENTION

This invention relates to an apparatus and process for the production of hosiery and, more particularly, to an improved hosiery article trimming and seam flattening system.

Conventional methods for knitting of hosiery articles, especially men's and children's socks, require that the hose be knitted with an opening across the top of the toe portion. This opening must be subsequently closed in a separate operation. Typically, the opening is closed by sewing opposite edges of the opening together utilizing overedge stitching, while the hose is in an inside-out condition. Such an operation leaves a raised, uneven seam across the toe portion. A still further operation must flatten the seam across the toe portion so that the hose may be confortably worn and present an attractive appearance.

Additionally, the process of knitting the hose may result in a plurality of unfinished threads hanging from the hose. Therefore, a trimming operation must be performed to trim away these unfinished threads in order for the sock to be confortably worn and appear presentable.

The seam across the toe portion runs generally perpendicular to the length of the hose. The use of the overedge stitching enables flattening of the seam by stretching the hose along its length, that is, perpendicular to the seam.

The apparatus disclosed in the U.S. Pat. No. 3,532,258 is intended to stretch hosiery in order to flatten the toe seam. The apparatus disclosed includes a vertical turntable or turret rotating about a horizontal axis, and a plurality of tubular members of uniform length and diameter extending horizontally from the turret. The turret is rotated intermittently so that each tubular member may arrive and be operated on at each of four work stations.

At the first work station, hose is placed around the tubular member with the toe seam inside out adjacent to the end of the tubular member opposite the turret. The turret is then rotated so that the tubular member and hose arrive at work station two.

At work station two, an extendable stretching device which is coaxial with the tubular member extends through the end of the tubular member, drawing with it the end of the hose including the toe seam. The stretching device is conical, so that its diameter becomes greater than the diameter of the tubular member. Thus, when the stretching device is inserted in the tubular member, the stretching device contacts the tubular member and sandwiches the hose in a tight grip between the stretching device and the tubular member. The front portion of the stretching device is then extended away from the conical body section and further into the tubular member thereby stretching the toe seam. The sandwich of the hose between the conical section and the tubular member prevents the upper portion of the hose from slipping within the tubular member to relieve the force exerted on the hose by the stretching operation. After the stretching operation, the stretching means is removed from the interior of the tubular member and the turret is rotated to bring the tubular member to work station three.

At work station three, a partial vacuum is applied at the turret end of the tubular member and rotating disks adjacent to the exterior of the tubular member roll the top end of the hose toward the end of the tubular member. This operation allows the majority of the hose to be drawn within the tubular member in a rightside-out orientation. Screens at the turret end of the tubular member prevent the hose from being removed therefrom by the partial vacuum. The turret is then rotated so that the tubular member arrives at work station four.

At work station four, a positive pressure is applied at the turret end of the tubular member so that the hose is expelled at the opposite end into a removal tube. The turret is rotated so that the tubular member arrives at work station one for reloading.

One deficiency of the prior art apparatus described above is that the positive pressure applied at work station four tends to revert the hose to an inside-out orientation prior to expulsion from the tubular member. The final orientation of the hose is dependant on a number of factors, including the coefficient of friction between the hose material and the tubular member material as well as the amount of partial vacuum and positive pressure applied at work stations three and four. Therefore, the items expelled at work station four must be individually sorted by hand to determine which items are inside-out and revert those items to rightside-out orientation as necessary.

The apparatus altogether fails to address the problem of unfinished threads extending from the hose.

SUMMARY OF THE INVENTION

The present inventive process overcomes the deficiencies in the prior art recognized above by providing a step in which the tubular member is rotatable about its own central axis. During rotation of the tubular member, substantially the entire periphery of the hose on the tubular member is exposed to clipping shears which sever and remove unfinished threads extending from the hose. Additionally, the present invention provides a novel means for removal of finished hose from the stretching apparatus which assures that the hose is removed in rightside-out orientation. Further, the present invention provides energy efficient features which improve the economy of operation of the apparatus over that of the prior art.

The present inventive apparatus comprises a turret and a plurality of tubular members extending from the turret. The turret is rotated intermittently so that each tubular member arrives at a plurality of work stations. At work station one, hose is placed inside-out around the tubular member with the toe seam adjacent the end of the tubular member opposite the turret. At work station two, the tubular member is rotated about its own axis so that the hose is rotated in the vicinity of shears which trim unfinished threads. At work station three, the hose is subjected to stretching by a stretching device which extends into the tubular member. At work station four, the hose is removed from the outside of the tubular member by a pad moving along the tubular member, and is then blown through the tubular member in the direction of the turret at which point it is removed through a conduit adjacent the turret and coaxial with the tubular member.

BRIEF DESCRIPTION OF THE DRAWINGS

These and other objects and advantages of the present invention will become more readily apparent in the course of the description appearing below when read in conjunction with the accompanying drawings, in which.

DETAILED DESCRIPTION OF THE DRAWINGS

Figure 1:
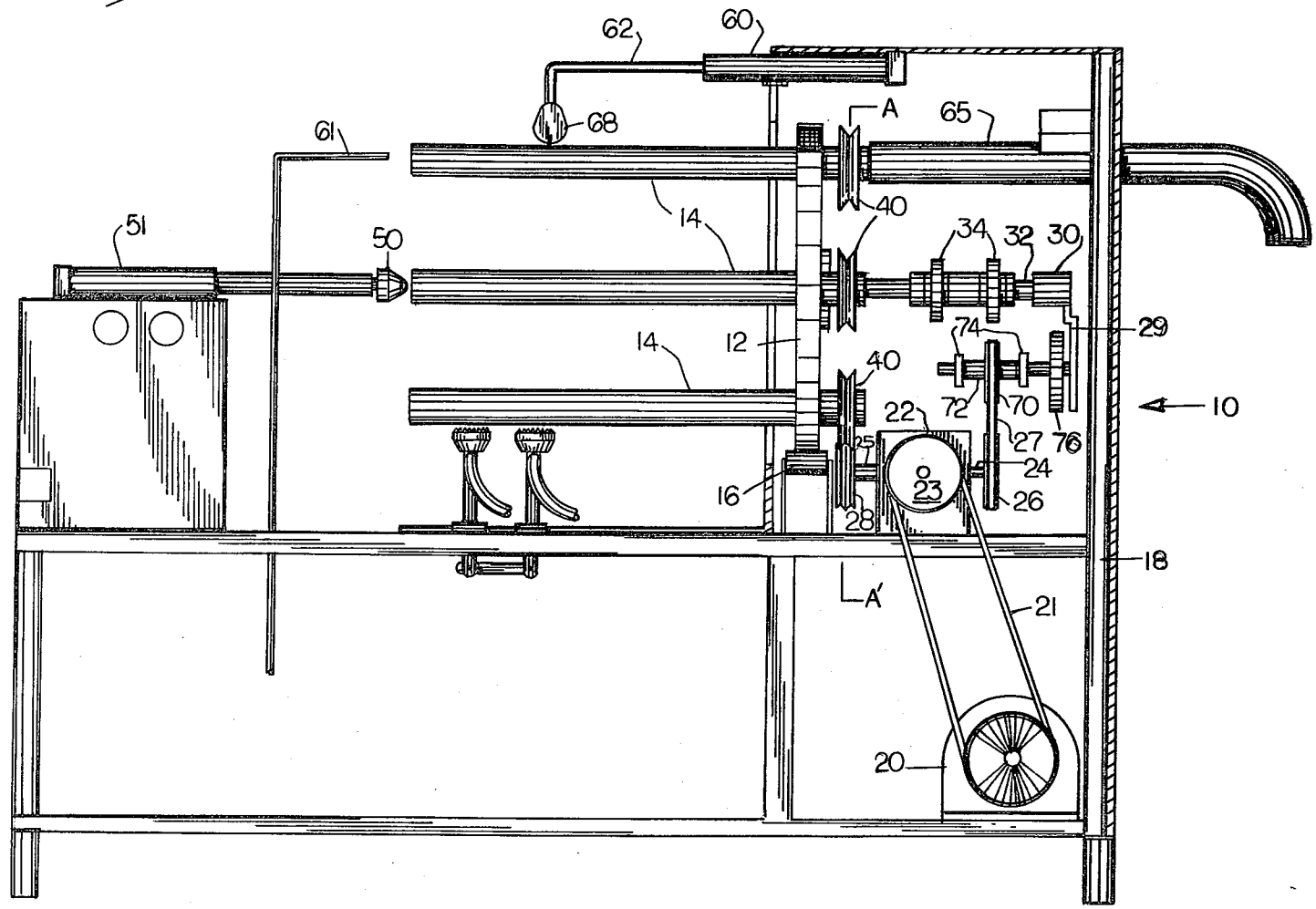
FIG. 1 is a front view of the inventive apparatus.

The best mode and preferred embodiment of the present invention is illustrated in FIGS. 1 through 9. In FIG. 1, the inventive apparatus is generally indicated at 10, and comprises a frame 18, a turret 12 rotatably mounted to said frame 18, and a plurality of tubular members 14 extending from the turret 12 with the axes of tubular members 14 parallel to the axis of turret 12.

Rotational energy from a motor 20 (of any conventional type with a rotating drive shaft) is transferred to rotate the turret 12 intermittently, in order to move the tubular members 14 between consecutive work stations for work to be performed on hose placed around the ends of tubular members 14. Motor 20 rotates pulley 19, which drives V-belt 21 to rotate pulley 23 of reduction transmission 22. Transmission 22 rotates shaft 24, which in turn rotates transfer sheave 26. Transfer sheave 26 drives V-belt 27 to drive sheave 70.

Sheave 70 rotates transfer shaft 72 which is mounted to frame 18 by transfer shaft mounts 74. Eccentric crank 76 is driven by shaft 72 and drives connecting rod 29 which is coupled to turret clutch 30. Turret clutch 30 is an overrun clutch, so that rotation of clutch 30 by connecting rod 29 in a positive direction will advance the tubular members to consecutive work stations while rotation of clutch 30 by connecting rod 29 in an alternative negative direction will not rotate turret 12. Clutch 30 drives turret drive shaft 32, which passes through drive shaft mounts 34 attached to frame 18 and is fixed to the center of turret 12.

Figure 2:
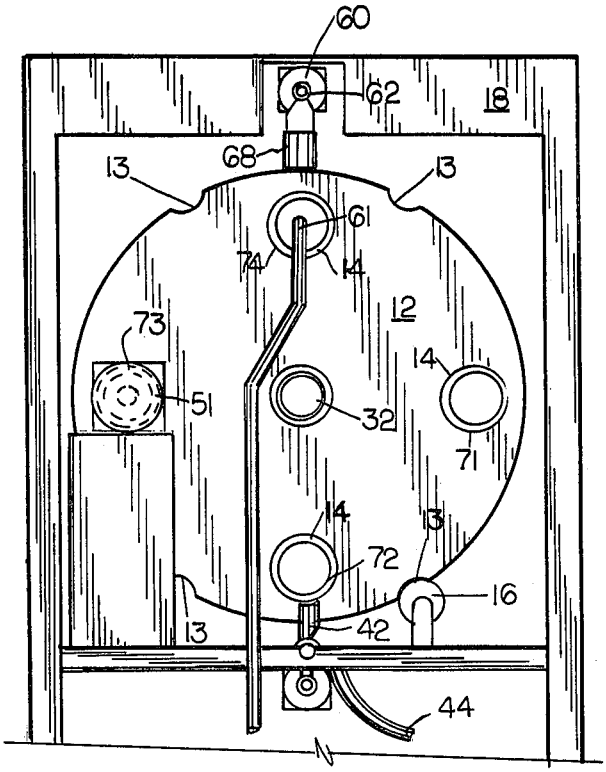
FIG. 2 is a side view of the apparatus of FIG. 1.

Referring now to FIG. 2, tubular members 14 are equally spaced about the periphery of the turret 12 and extend therefrom with their axes parallel to the axis of the turret 12. In the illustrated embodiment of the invention, there are four tubular members 14 corresponding to the four work stations located at 71, 72, 73 and 74. However, a larger number of tubular members 14 may be spaced equally about the periphery of the turret 12. The reducing transmission 22, connecting rod 29 and parts coupled therebetween as discussed above are arranged so that each rotation moves turret 12 a fraction of its circumference equal to the inverse of the number of tubular members 14 supported thereon. Thus, in the illustrated embodiment, each rotation of the turret carries the tubular members 14 precisely one quarter of a revolution around the turret 12.

Also spaced equally about the periphery of turret 12 are a plurality of semicircular notches 13, the number of which equals the number of tubular member 14. A spring-loaded roller 16 presses against the periphery of turret 12, and will enter any notch 13 which meets roller 16 as turret 12 revolves. The notches 13 and roller 16 are placed so as to prevent turret 12 from rotating under its own momentum when connecting rod 29 rotates clutch 30 in a negative direction, and thus hold turret 12 in precise position for hosiery processing. When connecting rod rotates clutch 30 in a positive direction, the torque on turret 12 is sufficient to force roller 16 out of a notch 13.

Figure 4:
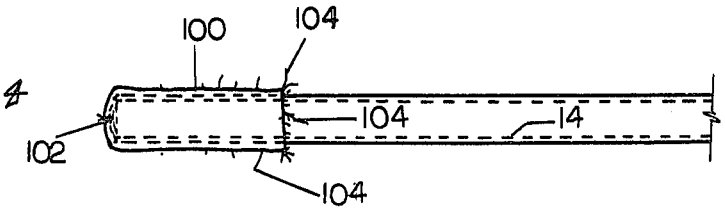
FIG. 4 is an isolated front view of a tubular member in work station one.

FIG. 4 illustrates the operation which takes place at work station one corresponding to location 71 in FIG. 2. Hose 100 is placed around the end of tubular member 14 opposite the turret 12. The hose 100 is inside-out so that the seam 102 is exposed. Additionally, unfinished threads 104 may extend from the vicinity of the top end of the hose.

Figure 5:
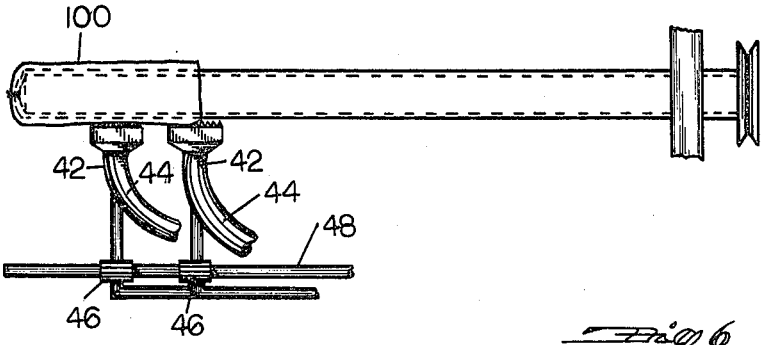
FIG. 5 is an isolated front view of a tubular member in work station two.

FIG. 5 illustrates the operation which takes place at work station two which corresponds to position 72 in FIG. 2. The tubular member 14 bearing hose 100 is rotated about its own axis so that vacuum shears 42 directly adjacent the hose 100 trim and remove the unfinished threads 104. The trimmed threads 104 are removed through vacuum tubes 44. Vacuum shears 42 are mounted on support bar 48 which is parallel to tubular member 14. Adjustable clamps 46 clamp the shears 42 to the support bar 48, and may be loosened so that the shears 42 may be moved along the support bar 48. This allows adjustment of the shears 42 according to the length of different types of hose 100 to be trimmed.

Figure 3:
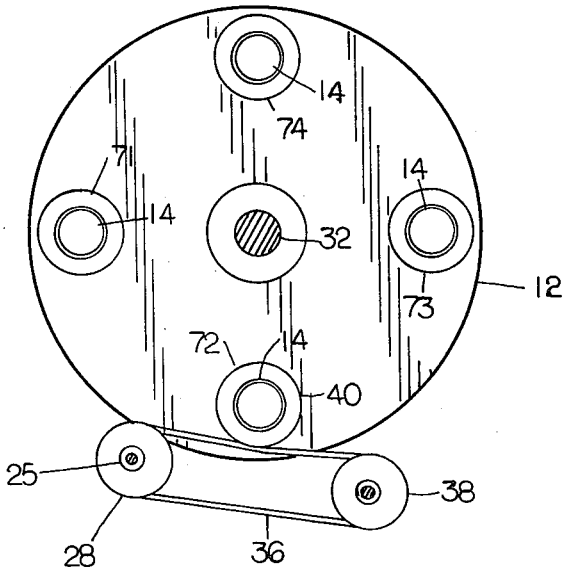
FIG. 3 is a cross sectional view taken along line A–A' of FIG. 1.

Referring again to FIG. 1, the reduction transmission 22 also drives shaft 25 connected to tubular member sheave 28. Referring now to FIG. 3, sheave 28 is a V-belt pulley which drives double V-belt 36 around a free wheel pulley 38. Each tubular member 14 is rotatably mounted to turret 12 and extends therethrough. On the end of each tubular member 14 adjacent double V-belt pulley 36 is mounted a V-belt pulley 40. As the turret 12 is rotated, a tubular member 14 reaches location 72 corresponding to work station two, and the pulley 40 attached to this tubular member 14 comes into contact with the moving V-belt 36. Thus, the pulley 40 and tubular member 14 are driven to rotate by the moving V-belt 36. After a length of time sufficient to complete the operations at the four work stations, the turret 12 is again rotated and the pulley 40 is removed from contact with the V-belt 36, thereby ending rotation of the tubular member 14 at work station two.

Figure 6:
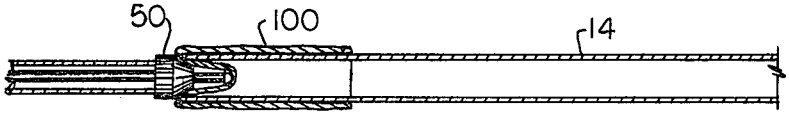
FIG. 6 is an isolated front view of a tubular member in work station three.
Figure 8:
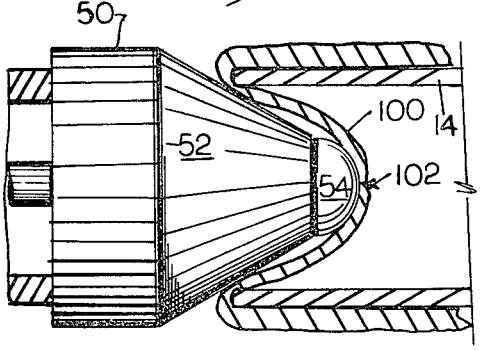
FIG. 8 is an isolated enlarged front view of a tubular member in work station three, showing a stretching ram in place against a tubular member prior to the stretching operation.
Figure 9:
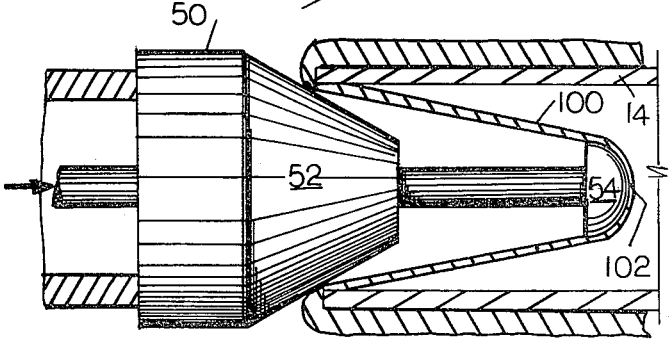
FIG. 9 is an isolated enlarged front view of a tubular member in work station three, showing the stretching ram stretching the hose on the tubular member.

FIGS. 6, 8 and 9 illustrate the stretching of the hose 100 which takes place at work station three corresponding to location 73. A stretching ram 50 extends from ram power source 51 so that ram 50 is directly adjacent the seam 102 of hose 100 on tubular member 14. The stretching ram 50 comprises a body 52 of frustro-conical shape, the base of which is larger in diameter than the diameter of tubular member 14. The body 52 is capped with a ram extension 54 which may extend from the body 52. As shown in FIG. 8, the ram 50 is placed against the end of tubular member 14 so that body 52 extends into tubular member 14 and sandwiches the hose 100 between body 52 and tubular member 14. This sandwich grips the hose 100 and prevents the top end of hose 100 outside of the tubular member 14 from being pulled within tubular member 14 during the stretching operation. After the hose 100 is sandwiched, the ram extension 54 extends from the body 52 as shown in FIG. 9 to stretch the hose in the area of seam 102. After stretching sufficient to straighten the seam 102, the ram extension 54 is withdrawn to body 52, and the ram 50 is withdrawn from the tubular member 14. Ram power source 51 may be any conventional power system such as pneumatic, hydraulic, or mechanical systems.

Figure 7:
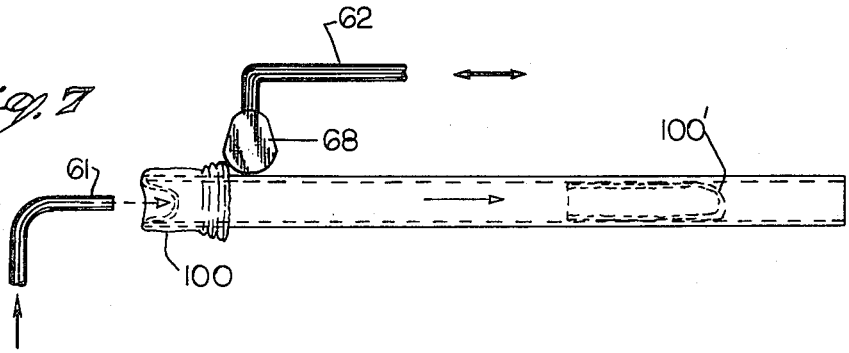
FIG. 7 is an isolated front view of a tubular member in work station four.

FIG. 7 illustrates the removal of hose 100 at work station four corresponding to location 74. After the hose 100 has been stretched at work station 3, the toe portion of the hose including seam 102 remains loosely within tubular member 14. A friction pad 68 adjacent tubular member 14 at work station 4 is driven along the length of tubular member 14 to urge the open end of hose 100 to the end of tubular member 14. The friction pad 68 is attached to piston shaft 62 of air cylinder 60. Activation of air cylinder 60 extends piston shaft 62 away from cylinder 60 and therefore drives friction pad 68 along tubular member 14. As the friction pad 68 moves along tubular member 14, air supply 61 supplies compressed air to force the hose 100 further into the tubular member 14. Thus, when the friction pad 68 reaches the end of tubular member 14, the hose 100 is completely enclosed by tubular member 14 and is completely everted to a rightside-out configuration. Referring now to FIG. 1, a removal conduit 63 is aligned with the tubular member 14 in work station 4 and so may receive the rightside-out hose 100' which is blown through tubular member 14. The removal conduit 63 conducts the hose to any further processing operations such as inspection or packaging.

It should be apparent that while there has been described above what is presently considered to be a preferred form of the present invention, changes may be made and steps interchanged in the disclosed apparatus and process without departing from the true scope and spirit of this invention as set forth in the following claims.

What is claimed is:

1. An apparatus for trimming unfinished threads and flattening a toe seam in a hosiery article comprising: a plurality of elongated tubular members, each said tubular member being hollow and having first and second open ends, each said tubular member being adapted to receive on its exterior a hosiery article with a toe portion of said hosiery article covering said first open end of said tubular member, a turret, each said tubular member being movably mounted adjacent said second open end to said turret, said turret being rotatably driven so that each said tubular member arrives at a plurality of work stations; shear means, said shear means being adjustably placed adjacent one of said work stations so that said hosiery article on said tubular member will expose unfinished threads to said shear means, rotation means, said rotation means being adapted to rotate each said tubular member when each said tubular member arrives at said one of said work stations adjacent said shear means; stretching means, said stretching means being aligned axially with respect to each said tubular member at another of said work stations, said stretching means being adapted to clamp said hosiery article between said stretching means and said first open end of each said tubular member and to stretch said toe seam in a direction parallel to the length of said hosiery article; removal means, said removal means being adjacent to a third one of said work stations and comprising means to urge said hosiery article along each said tubular member towards said first open end of each said tubular member, and compressed air means to supply compressed air to urge said hosiery article through the interior of said tubular member and through said second open end of said tubular member, said removal means comprising cylinder means mounted adjacent said third one of said work stations parallel to each said tubular member, and friction pad means coupled to said cylinder means and adapted to be driven toward said first open end of each said tubular member in contact with said hosiery article and each said tubular member by said cylinder means, each said tubular member further comprising a sheave member encircling said second open end of each said tubular member, said rotation means comprising a V-belt mounted adjacent said turret and adapted to releasably engage and rotate said sheave member of each said tubular member at said one of said work stations.

2. The apparatus of claim 1 further comprising an eccentric crank, an overrun clutch, and drive shaft means, and wherein said turret is coupled to and driven to rotate by said eccentric crank operatively connected to said overrun clutch, said overrun clutch being connected to said drive shaft means coaxial with and connected to said turret.

3. The apparatus of claim 2 wherein said turret is driven to rotate by said clutch during positive motion of said crank a fraction of the circumference of said turret equal to the inverse of the number of said tubular members.

4. The apparatus of claim 1 further comprising vacuum means coupled to said shear means and adapted to remove trimmed threads from the vicinity of said hosiery article.

5. The apparatus of claim 1 wherein said removal means further comprises conduit means, said conduit means being axially aligned with said tubular member, said conduit having an open end adjacent to said second open end of said tubular member so that said hosiery article may be driven through said tubular member and said conduit means by said compressed air means to be expelled from said apparatus.

6. The apparatus of claim 1 wherein said turret defines a plurality of notches equally spaced about the periphery of said turret, the number of said notches being equal to the number of said tubular members, and including roller means mounted to said frame adjacent said turret and adapted to enter each said notch to arrest rotation of said turret when said tubular members arrive at said work stations.

* * * * *